United States Patent [19]

Ellis et al.

[11] 4,217,159

[45] Aug. 12, 1980

[54] LAYING ORIENTED FIBROUS WEBS

[75] Inventors: Peter M. Ellis; Robert D. Gibb, both of Harrogate, England

[73] Assignee: Imperial Chemical Industries Limited, London, England

[21] Appl. No.: 951,953

[22] Filed: Oct. 16, 1978

[30] Foreign Application Priority Data

Oct. 26, 1977 [GB] United Kingdom ..... 44537/77

[51] Int. Cl.[2] ..... D04H 3/04; D04H 3/10; D04H 3/12

[52] U.S. Cl. ..... 156/177; 19/299; 28/289; 156/181; 156/439; 156/441

[58] Field of Search ..... 156/181, 180, 177, 439, 156/440, 441, 436, 296, 167, 285; 226/97; 28/101, 100, 289; 19/299, 65 T; 112/440, 262

[56] References Cited

U.S. PATENT DOCUMENTS

| | | | |
|---|---|---|---|
| 2,622,306 | 12/1952 | Anderson | 28/100 |
| 3,293,718 | 12/1966 | Sheets | 28/101 |
| 3,460,731 | 8/1969 | Troth, Jr. | 19/299 |
| 3,488,819 | 1/1970 | Jackson | 28/100 |
| 3,511,625 | 5/1970 | Pitt | 19/299 |
| 3,563,838 | 2/1971 | Edwards | 156/181 |
| 3,766,606 | 10/1973 | Piper et al. | 28/283 |

FOREIGN PATENT DOCUMENTS

| | | |
|---|---|---|
| 292178 | 8/1971 | Austria . |
| 2421401 | 8/1977 | Fed. Rep. of Germany . |
| 48-11795 | 4/1973 | Japan . |
| 50-07178 | 3/1975 | Japan . |
| 1244753 | 9/1971 | United Kingdom . |
| 1244754 | 9/1971 | United Kingdom . |
| 1314588 | 4/1973 | United Kingdom . |
| 1341998 | 12/1973 | United Kingdom . |

*Primary Examiner*—Michael W. Ball

*Attorney, Agent, or Firm*—Cushman, Darby & Cushman

[57] ABSTRACT

A process and apparatus for laying highly ordered webs wherein a fibrous strand forwarded towards a collecting surface is caused to oscillate up to an amplitude equal to the desired web width and by passing between two closely spaced plates is laid in successive courses with a very high degree of parallelism and precision. A plurality of the laying devices may be used to produce thicker or wider webs or webs having layers of differing orientation directions. Various bonding methods may be applied to the ordered webs.

11 Claims, 2 Drawing Figures

LAYING ORIENTED FIBROUS WEBS

Figure 1:
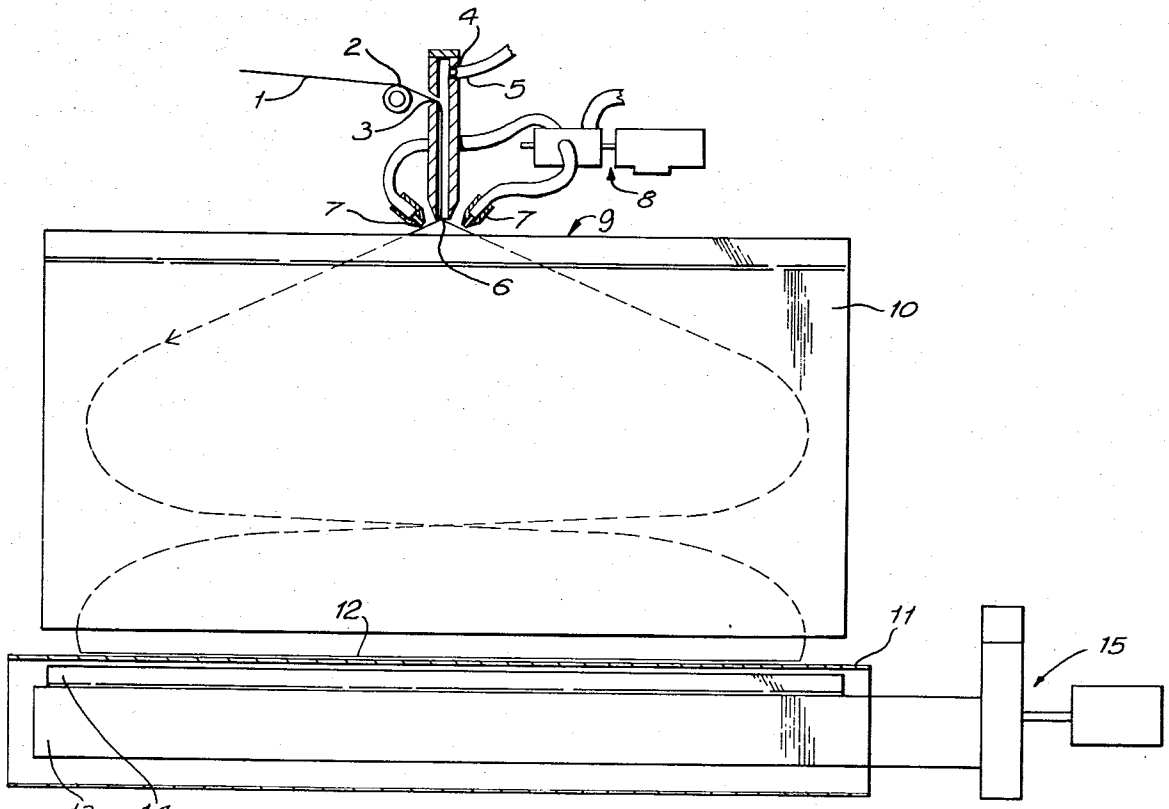

This invention relates to the production of fibrous webs having a high degree of orientation of the fibrous strands comprising a web, comprising forwarding a strand towards a collecting surface and imparting an oscillatory motion to the strand at a point above the collecting surface.

Fibrous webs have been made from staple fibres by carding or by random air laying processes, the former process imparting some degree of isotropic arrangement of the fibres. Fibrous webs have also been made by collecting a mat of synthetic continuous filaments in which the filaments are more or less randomly intermingled in the mat. However in order that a fabric made from one or more webs should have properties which resemble more closely the properties of conventional woven or knitted fabrics it is considered desirable to introduce a high degree of orientation of the fibrous material composing a web, as for example, a high degree of parallelism in staple fibre yarns or filamentary strands oriented in for example, the machine or cross directions or in both these directions. Methods which have been proposed for introducing the desired orientation into a web of filamentary strands include those in which the extruded multifilamentary strands are forwarded and drawn by means of air jets and the issuing filaments are given an oscillatory motion before freely falling onto a collecting brattice or support. UK specification No. 1 244 753 describes such a method wherein gas oscillating jets are supplied with already drawn filaments. It has also been proposed in Japanese patent publication No. 75 007 178 to oscillate the outlet of the forwarding jet to impart the desired oscillatory motion to the emerging filaments. The prior methods have not in practice proved entirely satisfactory in producing webs of as high a degree of parallelism and order as desired. Thus it is an object of this invention to provide a method in which movement of a strand in the laying down of a web is more fully controlled so as to approach more nearly the desired high degree of parallelism and order.

Thus by the present invention we provide a process for the production of an ordered web from at least one fibrous strand, comprising forwarding a strand towards a collecting surface, imparting an oscillatory motion to the strand at a point above the collecting surface, characterised in that the oscillating strand is passed between two closely spaced plates which are substantially parallel to each other and to the plane of strand oscillation and which extend substantially from the place of oscillation down to the collecting surface whereon the strand is laid substantially parallel to the preceding lengths of the strand.

Also according to the invention apparatus for laying down a fibrous strand in substantially parallel courses comprises means for supplying a fibrous strand, means for forwarding the strand, means to impart an oscillatory motion to the forwarded strand and a collecting surface whereon the strand is laid, characterised in that the apparatus includes two closely spaced plates which are substantially parallel to each other and to the plane of oscillation and which extend between the oscillating means and the collecting surface.

It is preferred to use a continuous filamentary strand in the present invention since these may be produced directly from a synthetic polymeric substance as for example by melt spinning. Staple fibre strands, preferably having only a low degree of twist, may also be used and the term "fibrous strand" as used herein includes both these and similar materials.

In producing a multifilamentary strand by melt extrusion of a synthetic polymer it is desirable to draw or orient the filaments to improve their strength and other physical properties. This may be done by forwarding the freshly extruded filaments at a high speed such that when they have cooled sufficiently any further drawing down of the still plastic filaments will cause orientation and alignment of the polymer chains which is set in on further cooling of the filaments to a temperature below the glass transition point. A gas forwarding jet is a convenient means to forward the strand and to produce this orientation. Means to impart an oscillatory motion to the strand may also utilise a compressed gas. Thus jets may be located on opposite sides of the forwarding jet outlet and operated alternately so as to direct the issuing strand first in one direction and then in the opposite direction. Alternatively a single intermittently operated jet may be used to impart the oscillatory motion.

A single or two port rotary valve may be conveniently used to provide the alternate or intermittent operation of the two jets or the single jet and the speed of rotation of this valve provides a simple control over the amplitude of oscillation described by the strand; the rotation speed bearing an inverse relationship to the strand amplitude when other conditions are constant. Thus the length of the courses of the strand laid on the collecting surface may be set within at least the range 0.5–4 m by adjustment of rotary valve speed particularly because the use of closely spaced plates between the oscillating jets and the collecting surface allows changes to have their full effect on strand movement. Oscillating jets may have a single orifice or number of orifices in line or preferably a narrow slot for exit of the compressed gas. It is preferred to mount the deflecting jets so that both the angle between the jets, if two are used, and the angle of the or each jet in relation to the issuing strand may be adjusted as a further means of controlling strand oscillation.

While deflecting gas jets are preferred, other devices may be used to impart oscillation to a strand provided they can induce a sufficiently large amplitude of oscillation at the collecting surface. Such alternative devices may be rotating or oscillating opposed pairs of coanda surfaces which are alternately brought into contact with the issuing strand.

Forwarding jets are well known in the art consisting of entry and exit passages for the strand and means to introduce the forwarding gas. The exit passage may be convergent or divergent but it is preferred to use a parallel passage to maintain the integrity of the issuing strand passing to the place of oscillation.

We have found that when closely spaced plates are provided between the forwarding/oscillating means and the collecting surface the strand will assume a planar wave form oscillation the amplitude of which may increase in successive half waves from the place of oscillation up to a value dependent upon the forces involved and will maintain this planar motion until it reaches the collecting surface whereon it is laid in substantially parallel regular courses. It is preferred that the height of the plates above the collecting surface is about the same as the distance required to establish the first crest in the waveform oscillation or the maximum amplitude if an oscillation of this kind is established. The plates should extend as close to the place of oscillation and as close to the collecting surface as is practicable so that maximum control of the falling strand is maintained.

The method and apparatus of this invention make it possible to lay highly oriented webs in which the strands are laid in parallel courses with an exactitude and precision hitherto impossible. A measure of this exactitude or efficiency may be defined as follows:

$$\text{Efficiency } E = \frac{\text{Actual web width } (m)}{\text{Length of strand/course } (m)}$$

The denominator may be expressed as:

$$\frac{\text{strand speed at point of oscillation } (m/\text{min})}{2 \,.\, \text{strand oscillation rate (cycles/min)}}$$

Thus E (%) may be expressed as:

$$E = \frac{2\,W\,R}{S}\,100$$

where

E is the percentage laying efficiency

W is the actual web width in meters

R is the oscillation rate, cycles/min and

S is the strand speed at oscillation (or issue from the forwarding means) in m/min.

Strand laying efficiency defined in this way is an overall measure of effectiveness and for example in laying webs of continuous synthetic filamentary yarns values of 95% and better are attained and in these webs for all but a few percent of web width at the edges the efficiency is substantially 100%.

Use of this invention is particularly beneficial in the laying of such highly parallel webs of widths in excess of 0.5 m and at high strand speeds. Thus webs of 2.5 m width may be laid at a strand speed of at least 3600 m/min with an overall efficiency of 96% or more. In addition the laying of each course may be conducted with a very high precision to produce a web of substantially uniform thickness particularly when several strand laying devices are to be used together to produce a single or multi-layer web.

It is preferred to produce webs by moving the collecting surface away from the laying position at a speed related to the speed of strand laying in a direction either transverse to or parallel to the direction of laying. The former direction produces a web with transverse strand courses analgous to the weft of a woven fabric. The latter direction, when the strand laying device(s) is reciprocated transversely, produces successive bands of what may be termed warp wise strand courses. A plurality of laying devices may be used to lay webs having one or more layers of warp-and weftwise strand courses thus leading to a final web exhibiting two directional properties desirable in fabrics for use as apparel textiles.

Webs made according to this invention require to be bonded in some manner to convert them into useful fabrics and for this purpose it is preferred to use some form of segmental or spot bonding method so as to preserve the directional properties introduced in making the web. It is further preferred to include in the web at least a proportion of thermoplastic filaments or fibres and to employ a thermal segmental bonding method for making the final fabric. Such segmental bonding methods are described in for example United Kingdom patent specifications Nos. 1 245 088, 1 474 101 and 1 474 102. Thermoplastic synthetic filaments or fibres of many kinds are suitable for use in this invention either alone or in admixture with natural or other nonthermoplastic fibres. It is most preferred that the webs include or are composed of bicomponent synthetic fibres in which one of the components present at least in part at the surface of the fibre or filament is of lower softening or melting point, than the other and forms a strong bond under suitable conditions of heat and pressure. Alternatively or in addition to the foregoing segmental or spot bonding methods other processes may be used as for example, stitch bonding in which the web is held together by chains of stitching using a separate thread or part of the web itself and machinery which is capable of operating at fast production rates.

Synthetic polymeric filamentary strands being nonconductors and hydrophobic tend to accumulate static charges when in frictional contact with processing surfaces and as such charges may disturb the even oscillation or laying of a falling strand care is necessary to eliminate or reduce the accumulation of such charges by the provision of static discharging means at or near the point of oscillation or by surface treatment of the filaments with an appropriate chemical agent.

It is preferred, when using a gas forwarding jet, that a small amount of the issuing gas is allowed to pass in a gentle current down between the plates to assist the passage of an oscillating strand down to the collecting surface. It is also preferred that the collecting surface is a pervious brattice to allow escape of gas and if necessary the application of suction to the under side at the place of contact with a newly laid strand and thus to ensure its complete contact with the brattice.

The accompanying drawings illustrate the invention and one manner in which it may be performed using compressed gas both for transport and for oscillation of a strand.

Figure 2:
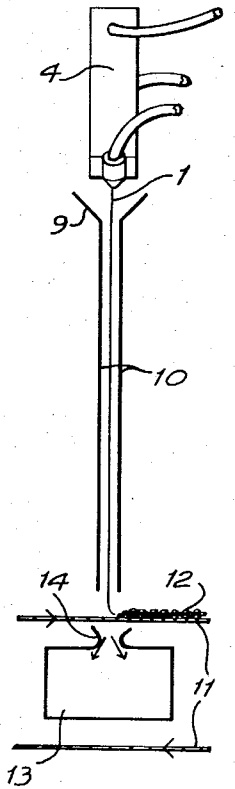

FIG. 1 is a front elevation of apparatus in which a strand is being laid transversely onto a foraminous conveyor and FIG. 2 is a side elevation of the apparatus of FIG. 1.

Referring to FIG. 1 a strand 1 is led by way of a small tension roll 2 into the entry 3 of a forwarding jet 4 which is supplied with compressed gas from a supply port 5 above the strand entry 3. The gas tensions the yarn forwards it to the outlet 6 close to which on either side are positioned deflection jets 7 which are alternately supplied with pulses of gas from a motorised rotary valve 8. The strand 1 falls from the jet outlet 6 into the convergent entry 9 of two parallel plates 10 narrowly spaced apart and arranged transversely and close to an endless foraminous conveyor 11. Gas jets 7 alternately are directed against the emerging strand 1 moving it to the left and then to the right and causing it to oscillate and to assume a planar sinuous path as it falls between plates 10. As the strand 1 passes between the plates 10 the initial motion imparted by the deflection jets 7 develops to its full extent until at the level of the conveyor 11 the strand has moved out to the full desired width and is then laid down on the conveyor in successive parallel courses 12 across the conveyor. To assist the regular and complete laying of each strand on the conveyor an exhaust duct 13 is positioned beneath the conveyor 11 and is provided with a narrow slot inlet 14 arranged close to the underside of the conveyor and immediately below the lower edges of plates 10. A fan 15 provides at the inlet 14 suction to draw the strands against the conveyor surface.

In FIG. 1 left and right moving lengths of strand 1 are shown moving in somewhat idealised fashion between plates 10 as solid and broken lines respectively. Examination of the apparatus illustrated in the drawings in the operating condition by means of stroboscopic illumination through a transparent plate 10 shows that the strand takes up a uniform sinuous path the form of which alters with changes in forwarding and oscillating speeds.

The plates 10 serve to control and stabilise the movement of the oscillating strand. The width of the plates in the direction of oscillation should be at least equal to and is preferably just a little wider than the maximum width of web to be laid. As described above the height of the plates depends upon the laying conditions used and the form of the strand path established. The plates should be as closely spaced as possible and preferably should taper slightly in the downward direction as for example from a spacing at the top of 4 mm to a spacing at the lower end of 2 mm. This taper assists the sideways exhaust of air and reduces the possible disturbance of strands on the collector. Likewise the distance between the lower ends of the plates and the collector is minimised consistent with maximising the efficiency and precision of laying that is to say so as to give maximum control of the strand while it is moving and immediately after it is laid. For higher strand speeds and web widths the functions of the plates become increasingly important. In the absence of one or both plates even at low strand speeds, narrow web widths and the complete absence of extraneous influences such as air currents entirely unsatisfactory irregular webs are formed.

The following Examples illustrate the invention and the manner in which it may be performed.

EXAMPLE 1

A strand composed of 60 synthetic filaments and with a final decitex of 200, spun direct from a spinneret, was led by way of rolls rotating at a speed of 3650 m/min to the entry of a forwarding jet supplied with compressed gas at a pressure of 1758 g/cm$^2$ gauge. A motorised rotary valve, supplied with compressed gas at a pressure of 5625 g/cm$^2$ gauge gave impulses of compressed gas in turn to each of two deflector jets, fitted immediately below the forwarding jet and symmetrically in relation thereto at an included angle of 165° between the jets. Each deflector jet receiving compressed gas from the rotary valve for 50% of the valve revolution. The rotary valve rotated at a speed of 2300 rpm. The strand emerging from the forwarding/deflecting device was passed between a pair of plates 0.9 m wide and 0.5 m high. The top of the plates were 1 cm below the exit from the spray device and the plates were spaced 4 mm apart at the top and 2.5 mm apart at the bottom. The bottoms of the plates were 3 cm above a horizontally disposed foraminous conveyor. A suction slot, positioned directly under the exit from the plates was in use. The total strand width laid down was 0.75 m compared with a theoretical width, calculated from the yarn and rotary valve speeds of 0.79 m, thus, giving an overall laying efficiency of 94%. For most of the spray width, the filaments were laid with substantially 100% parallelism the efficiency loss occurring in the 5 cm at each edge where filaments diverged during the threadline reversal.

EXAMPLES 2–5

Synthetic filamentary strands of various sizes were laid into highly oriented webs with the same apparatus as in Example 1 and the following processing parameters; plate sizes being changed to suit the desired web width;

| EXAMPLE | STRAND NO OF FILS | STRAND DTEX | STRAND SPEED M/MIN | FORWARDING JET SUPPLY PRESSURE G/CM$^2$ GAUGE | VALVE SUPPLY GAS PRESSURE G/CM$^2$ GAUGE | VALVE SPEED (RPM) | PLATE DIMENSIONS (M) WIDTH | PLATE DIMENSIONS (M) HEIGHT |
|---|---|---|---|---|---|---|---|---|
| 2 | 60 | 200 | 3550 | 2110 | 4218 | 1125 | 3.0 | 0.75 |
| 3 | 60 | 200 | 3600 | 2110 | 5625 | 700 | 3.0 | 0.75 |
| 4 | 60 | 167 | 1735 | 2812 | 2460 | 445 | 3.0 | 0.75 |
| 5 | 120 | 400 | 3650 | 2110 | 5976 | 2975 | 0.9 | 0.5 |

The webs were produced in the following widths at the indicated overall efficiencies (ie including the edge portions);

| EXAMPLE | WEB WIDTH(M) ACTUAL | WEB WIDTH(M) THEORETICAL | LAYING EFFICIENCY E, (%) |
|---|---|---|---|
| 2 | 1.56 | 1.58 | 99 |
| 3 | 2.5 | 2.57 | 97 |
| 4 | 1.85 | 1.95 | 95 |
| 5 | 0.57 | 0.61 | 93 |

COMPARATIVE EXAMPLES A AND B

Webs were laid from the same filamentary strand as used in Examples 2 and 3 and respectively (A and B) with the same processing parameters but in the absence of the plates, in an environment substantially free from extraneous draughts and other influences. The results were as follows:

| COMPARATIVE EXAMPLE | WEB WIDTH (M) ACTUAL | WEB WIDTH (M) THEORETICAL | E, (%) |
|---|---|---|---|
| A | 1.25 | 1.58 | 79 |
| B | 2.2 | 2.61* | 84 |

*Forwarding speed 3650 m/min.

It was only possible to lay a narrower web under these conditions and the laying efficiency was appreciably reduced in both cases in the absence of plates.

EXAMPLES 6

A web was laid from a synthetic filamentary strand as used in Example 1 with similar apparatus differing only in that the forwarding jet had a divergent exit passageway instead of a parallel one. The other process parameters and the results obtained were as follows:

| EXAMPLE | FORWARDING JET SUPPLY PRESSURE (G/CM² GAUGE) | VALVE SUPPLY GAS PRESSURE (G/CM² GAUGE | VALVE SPEED (RPM) | PLATE DIMENSIONS (M) WIDTH | HEIGHT | WEB WIDTH (M) ACTUAL | THEORETICAL | E (%) |
|---|---|---|---|---|---|---|---|---|
| 6 | 3867 | 5976 | 2000 | 0.9 | 0.5 | 0.70 | 0.8 | 87 |

The web laying efficiency is moderately high but is not as good as with the forwarding jet of the preceding Examples.

COMPARATIVE EXAMPLE C

For comparison a web was prepared substantially as described for Example 6 but omitting the plates between oscillating and collecting means with the following poor results:

| COMP EXAMPLE | FORWARDING GAS PRESSURE (G/CM² GAUGE) | VALVE SUPPLY GAS PRESSURE (G/CM² GAUGE) | VALVE SPEED (RPM) | PLATE DIMENSIONS(M) WIDTH | HEIGHT | WEB WIDTH (M) ACTUAL | THEORETICAL | E(%) |
|---|---|---|---|---|---|---|---|---|
| C | 2812 | 5976 | 2030 | 0.9 | 0.5 | 0.68 | 0.9 | 76 |

We claim:

1. A process for the production of an ordered web from at least one fibrous strand, comprising forwarding a strand towards a moving collecting surface, imparting an oscillatory motion to the strand at a point above the collecting surface and passing the oscillating strand between two closely spaced plates which are substantially parallel to each other and to the plane of strand oscillation and which extend substantially from the place of oscillation down to the collecting surface whereon the strand is laid in substantially parallel successive lengths of the strand.

2. A process according to claim 1 wherein the collecting surface is advanced during the laying process and the strand is laid transversely or parallel to the direction of advance of the collecting surface.

3. A process according to claim 1 wherein two or more strand laying devices are used together to lay the desired web thickness or width.

4. A process according to claim 1 wherein the ordered 20 web is bonded by adhesive, thermal or stitching means.

5. Apparatus for laying down a fibrous strand in substantially parallel courses comprising means for supplying a fibrous strand, means for forwarding the strand, means to impart an oscillatory motion to the forwarded strand and a collecting surface adapted to move relative to the strand oscillatory means and whereon the strand is laid and including two closely spaced plates which are substantially parallel to each other and to the plane of oscillation and which extend between the oscillating means and the collecting surface.

6. Apparatus according to claim 5 wherein the strand is forwarded and oscillated by gaseous fluid jets and some of the issuing gas is passed down between the plates.

7. Apparatus according to claim 5 wherein the plates are perforated.

8. Apparatus according to claim 5 wherein a static eliminating device is positioned before the plates close to the strand path.

9. Apparatus for laying one or more webs of substantially parallel fibrous strands wherein two or more devices according to claim 5 are used together to lay the desired web thickness or width on a single collecting surface.

* * * * *

UNITED STATES PATENT AND TRADEMARK OFFICE

CERTIFICATE OF CORRECTION

PATENT NO. : 4,217,159

DATED : August 12, 1980

INVENTOR(S) : Peter M. Ellis and Robert D. Gibb

It is certified that error appears in the above—identified patent and that said Letters Patent is hereby corrected as shown below:

In the claims:

Please add the following claims:

10. A process as in claim 1 wherein said substantially parallel plates converge slightly in the direction of strand movement.

11. Apparatus as in claim 5 wherein said substantially parallel plates converge slightly in the direction of strand movement.

Signed and Sealed this

*Eighth* Day of *November 1983*

[SEAL]

*Attest:*

GERALD J. MOSSINGHOFF

*Attesting Officer*

*Commissioner of Patents and Trademarks*